US005402635A

United States Patent [19]

Smith et al.

[11] Patent Number: 5,402,635

[45] Date of Patent: Apr. 4, 1995

[54] GAS TURBINE COMBUSTOR WITH COOLING CROSS-FLAME TUBE CONNECTOR

[75] Inventors: Kevin D. Smith; Jeffrey C. Eddy, both of Oviedo, Fla.

[73] Assignee: Westinghouse Electric Corporation, Pittsburgh, Pa.

[21] Appl. No.: 118,340

[22] Filed: Sep. 9, 1993

[51] Int. Cl.[6] ..... F02C 3/00

[52] U.S. Cl. ..... 60/39.37; 60/757

[58] Field of Search ..... 60/39.37, 39.32, 757, 60/756

[56] References Cited

U.S. PATENT DOCUMENTS

| | | | |
|---|---|---|---|
| 2,979,898 | 4/1961 | Ward | 60/39.37 |
| 3,001,366 | 9/1961 | Shutts | 60/39.37 |
| 3,184,918 | 5/1965 | Mulcahey | 60/39.37 |
| 3,811,274 | 5/1974 | Calderon | 60/39.37 |
| 5,265,413 | 11/1993 | Cannon et al. | 60/39.37 |

*Primary Examiner*—Richard A. Bertsch
*Assistant Examiner*—William Wicker
*Attorney, Agent, or Firm*—G. R. Jarosik

[57] ABSTRACT

The current invention concerns a combustor having a coupling for a cross-flame tube. The coupling has inner and outer sleeves that form an annular passage therebetween. Holes in the outer sleeve place the annular passage in flow communication with cooling air in the combustion system chamber, thereby causing the cooling air to flow over the proximal end of the outer sleeve. A baffle is formed on the inner sleeve and has a pattern of raised and depressed areas. The raised areas form lands that are attached to the combustor wall. The depressed areas form passages with the wall that direct the cooling air from the annular passage so that it flows over the surface of the combustor inner wall, thereby preventing over heating of the wall.

15 Claims, 5 Drawing Sheets

GAS TURBINE COMBUSTOR WITH COOLING CROSS-FLAME TUBE CONNECTOR

BACKGROUND OF THE INVENTION

The present invention relates to combustors for gas turbines. More specifically, the present invention relates to the portion of the gas turbine combustor that forms the coupling for connecting the combustor to a cross-flame tube.

A gas turbine combustor is typically comprised of a plurality of approximately cylindrical combustors circumferentially arranged within a combustor shell and surrounding the turbine rotor. The combustors are connected by cross-flame tubes. In addition, two adjacent ones of the combustors have high energy electric igniters. At start-up, ignition is established in the fuel/air mixtures in the combustors having igniters, thereby creating a flame. The cross-flame tubes then carry this flame from combustor to combustor around the array until a flame has been established in all of the combustors. Flame detectors in the two combustors that are opposite those with igniters verify that a flame has been established in each of the combustors. During operation, the cross-flame tubes act to re-establish combustion in any combustor that may experience a flame-out.

Traditionally, the cross-flame tubes were formed from a flexible metal hose having flanges at each end. The cross-flame tubes were attached to the combustors by ring-type compression clamps, commonly referred to as "marmon" clamps, that mated with couplings that projected from the combustors. Each coupling was formed by a substantially radially extending tube that was attached to the combustor at the proximal end of the tube and that had a flange formed on its distal end.

Typically, combustors are formed from a plurality of concentric rings joined by corrugations. These rings are cooled by flowing cooling air along the inner walls of the rings, thereby providing a thermal barrier against the heat emanating from the combustion zone within the combustor. This cooling air is introduced by annular cooling air passages formed between adjacent rings that allow the cooling air to enter the combustor and flow over the inner wall of the downstream ring.

Unfortunately, the presence of the cross-flame tube coupling disrupts the flow of cooling air along the inner wall of the ring. As a result, this cooling air scheme has proven ineffective in the portion of the ring downstream of the cross-flame tube coupling and at the inlet to the coupling tube. One solution attempted in the past involved supplying additional cooling air in the vicinity of the coupling by drilling a number of small holes around the circumference of the coupling adjacent the ring or in the ring itself in the portion that surrounds the coupling. However, this approach has not proven entirely successful.

It is therefore desirable to provide a gas turbine combustor having a cross-flame tube coupling in which a flow of cooling air is directed to the end of the coupling tube and over the combustor wall adjacent the coupling.

SUMMARY OF THE INVENTION

Accordingly, it is the general object of the current invention to provide a gas turbine combustor having a cross-flame tube coupling in which a flow of cooling air is directed to the end of the coupling tube and over the combustor wall adjacent the coupling.

Briefly, this object, as well as other objects of the current invention, is accomplished in a gas turbine having (i) a shell forming a chamber therein containing compressed air, (ii) first and second combustors disposed in the chamber, each of the combustors having a wall enclosing a combustion zone therein, and (iii) means for transporting a flame from the first combustor to the second combustor. The flame transporting means includes a conduit placing the first combustor combustion zone in flow communication with the second combustor combustion zone. The conduit has inner and outer sleeves that form an approximately annular first passage therebetween. An opening formed in the outer sleeve places the first passage in flow communication with the chamber, whereby the first passage receives the compressed air from the chamber, thereby cooling the outer sleeve.

In one embodiment of the invention, an approximately radially extending skirt is disposed around the inner sleeve. At least a first portion of the skirt is displaced from the combustor wall and forms a second passage between it and the wall. The first and second passages are in flow communication, whereby the second passage receives the compressed air from the first passage and causes the compressed air to flow over the combustor wall, thereby cooling the wall.

DESCRIPTION OF THE PREFERRED EMBODIMENT

Figure 1:
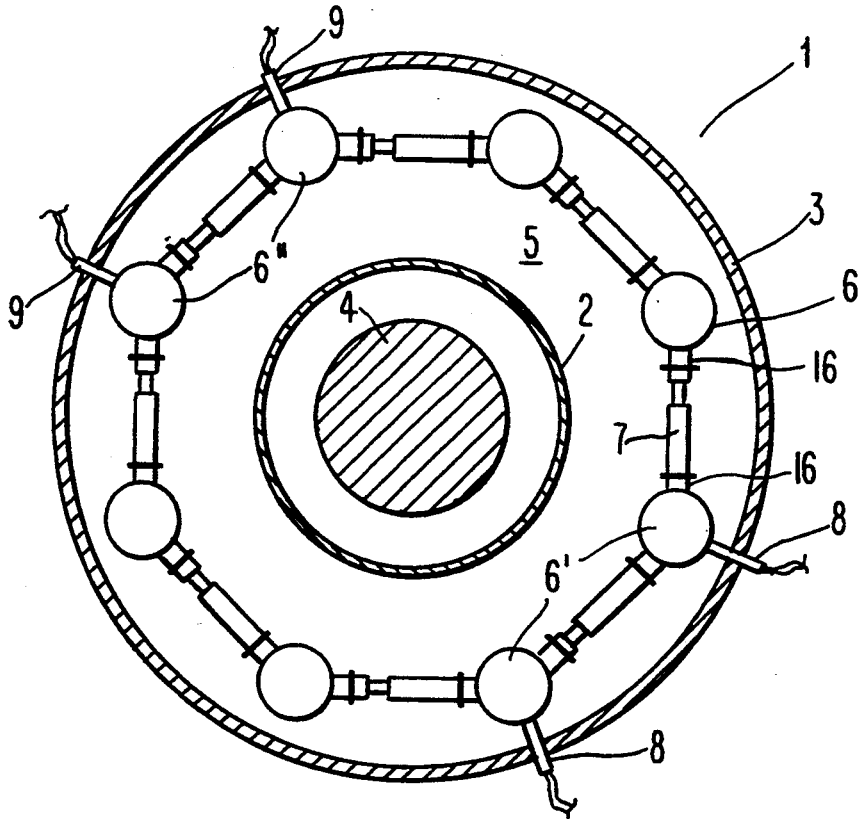
FIG. 1 is a transverse cross-section, partially schematic, through the combustion section of a gas turbine, showing combustors according to the current invention.

Referring to the drawings, there is shown in FIG. 1 the combustion section 1 of a gas turbine. The combustion section is comprised of inner and outer shells 2 and 3, respectively, that form an annular chamber 5 therebetween through which compressed air from the compressor section (not shown) flows. Typical gas turbine compressor and combustion sections are shown in U.S. Pat. No. 4,991,391 (Kosinski), hereby incorporated by reference in its entirety. The inner shell 2 encloses a centrally disposed rotor 4.

A plurality of approximately cylindrical combustors 6 are circumferentially arranged around the chamber 5. Igniters 8, which may be of the spark gap type, are disposed in two adjacent combustors 6'. Flame detectors 9, which may be of the ultra-violet light sensing type, are disposed in two adjacent combustors 6" opposite from the combustors 6' in which the igniters 8 are disposed. Cross-flame tubes 7 connect each of the combustors 6.

Figure 2:
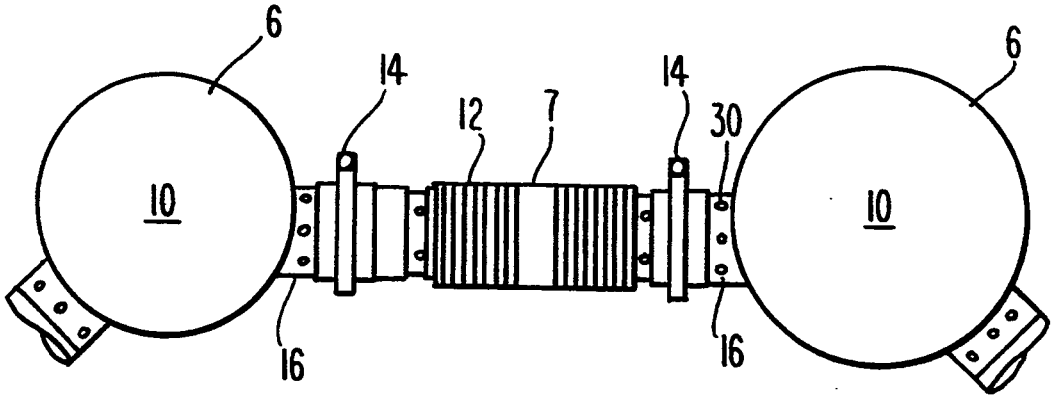
FIG. 2 is a detailed view of two of the combustors shown in FIG. 1 according to the current invention.

At ignition, the fuel/air mixture in each of the combustors 6' is ignited by a spark created by the igniters 8, thereby creating a flame within a combustion zone 10, shown in FIG. 2, formed within each of the combustors 6. The cross-flame tubes 7 allow the flame to propagate from combustor to combustor around the array until the fuel/air mixtures in all of the combustors has been ignited. The detection of flame in combustors 6" by the flame detectors 9 verifies that all of the combustors have been ignited.

As shown in FIG. 2, each cross-flame tube 7 is comprised of a flexible metal hose 12 having flanges on each of its ends. A marmon clamp 14 joins each of the cross-flame tube flanges with a mating flange 18, shown best in FIG. 4, formed on a cross-flame tube coupling 16 that extends approximately radially outward from the combustor 6.

Figure 3:
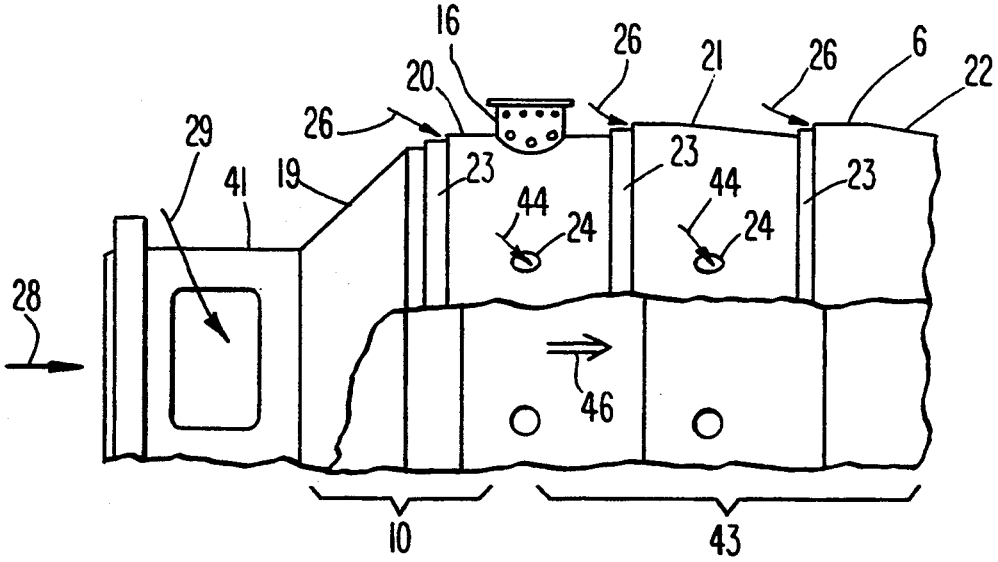
FIG. 3 is a side view, partially cut-away, of the front portion of one of the combustors shown in FIG. 2.

As shown in FIG. 3, the front portion of each combustor 6 is formed by concentric rings 20–22 that extend rearwardly from a dome 19 connected to the inlet 41 of the combustor. Fuel 28 and compressed air 29 are introduced into the combustor inlet 41 and ignite in the combustion zone 10. Additional compressed air 44 from the chamber 5 flows into the combustor 6 through holes 24 in the combustor rings 20 and 21 and mixes and cools the combustion gas 46 in a secondary zone 43.

Figure 4:
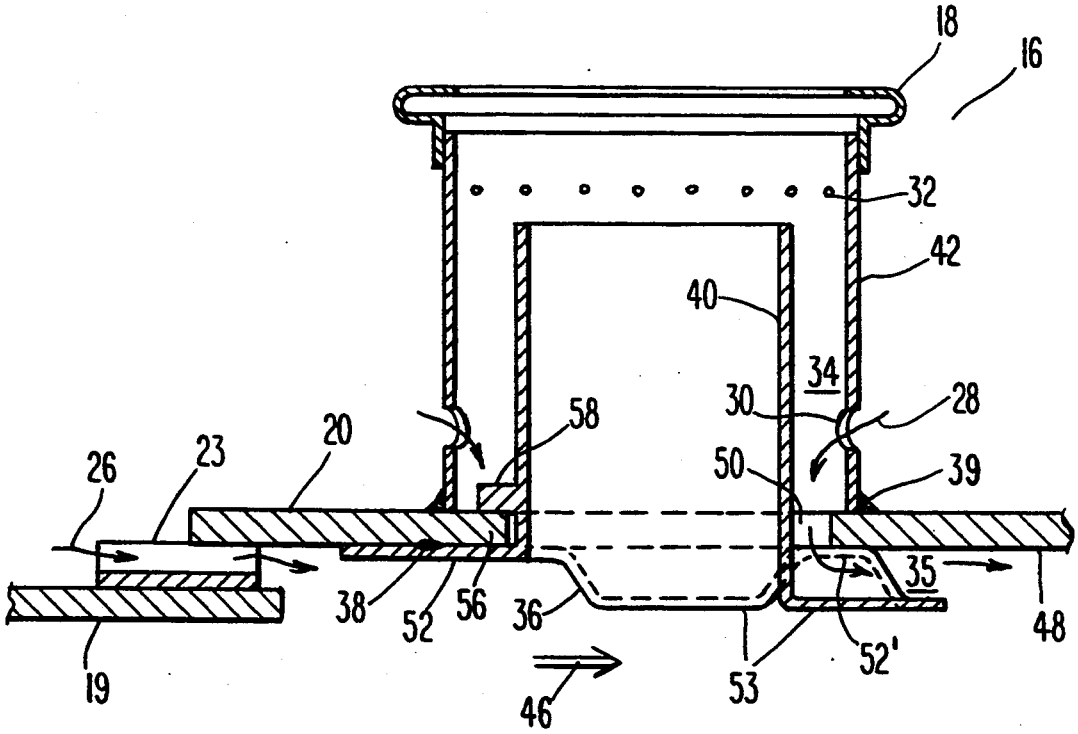
FIG. 4 is a longitudinal cross-section through the cross-flame tube coupling portion of the combustor shown in FIG. 3.

As shown best in FIG. 4, a corrugated strip 23 is disposed between the trailing edge of the first ring 19 and the leading edge of the second ring 20. The annular gap between the rings created by the strip 23 allows a layer of cooling air 26 from the chamber 5 to flow over the inner wall 48 of the ring 20, thereby providing a thermal barrier against the hot combustion gas 46.

The cross-flame tube coupling 16 comprises an outer sleeve 42 attached to the ring 20 at its proximal end so as to encircle a hole 50 formed in the ring, as shown in Figure 4. Although the outer sleeve 42 may be attached to the ring 20 in a variety of ways, in the embodiment shown in FIG. 4, the sleeve is attached by a fillet weld 39. A flange 18, for the marmon clamp 14, is attached to the distal end of the outer sleeve 42 and allows the cross-flame tube 7 to be secured to the combustor 6.

As previously discussed, the presence of the coupling 16 disrupts the flow of the layer of cooling air 26 over the ring inner wall 48. In the past, this disruption has resulted in overheating of the ring 20 downstream of the coupling 16, as well as overheating of the outer sleeve 42 in the vicinity of the hole 50.

According to the current invention, the overheating problem is solved by the use of an inner sleeve 40 that extends through the hole 50 in the ring 20, as shown in FIG. 4. The inner sleeve 40 is concentrically located within and encircled by the outer sleeve 42 so that the sleeves form an annular passage 34 between themselves. A number of holes 30 are distributed around the circumference of the outer sleeve 42, as shown best in FIG. 6. These holes allow cooling air 28 from the chamber 5 to enter the passage 34, as shown in FIG. 4. Additional cooling air enters the passage 34 via a number of smaller holes 32 just below the flange 18. The outer diameter of the inner sleeve 40 is smaller than the diameter of the hole 50 so that the cooling air 28 from the passage 34 flows radially inward and through the annular passage between the inner sleeve 40 and the inside diameter of the hole 50, thereby cooling the outer sleeve 42 in the vicinity of the hole.

Figure 5:
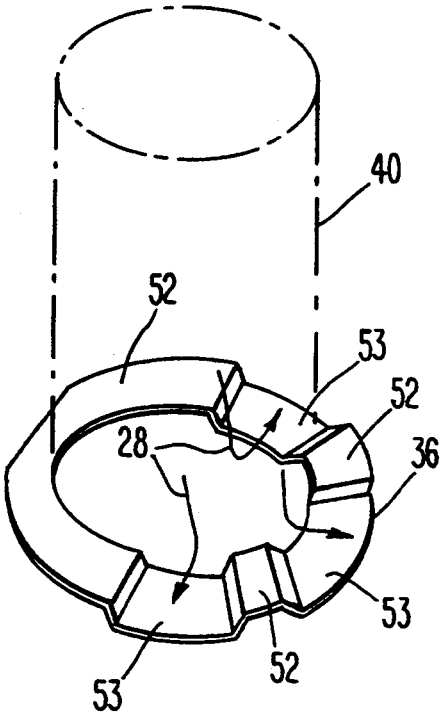
FIG. 5 is an isometric view of the skirt portion of the inner sleeve of the cross-flame tube coupling shown in FIG. 4, with the inner sleeve being shown in phantom.

According to an important aspect of the current invention, a baffle 36 is attached to the inner sleeve 40 at its proximal end. The baffle 36 extends substantially radially relative to the axis of the inner sleeve 40. Although the baffle 36 could be attached to the inner sleeve 40 in a variety of ways, in the embodiment shown in FIGS. 4–6, the baffle is integrally formed on the inner sleeve. As shown in FIG. 5, the baffle 36 is formed by a ring-shaped sheet metal skirt that encircles the circumference of the inner sleeve 40. The skirt is corrugated so that it forms raised lands 52 and depressed areas 53.

Each of the raised lands 52 are attached to the inner wall 48 of the ring 20 by a spot weld 38, one of which is shown in FIG. 4. The depressed areas 53 are thus displaced radially inward, relative to the axis of the combustor, from the inner wall 48 so as to form a passage 35 between the depressed areas and the inner wall. The passage 35 receives a radially directed flow of cooling air 28 from the annular passage 34 and causes it to turn approximately 90° so as to flow over the surface of the inner wall 48. Thus, a layer of cooling air 28 is formed on the inner wall 48 downstream of the coupling 16 that acts as a thermal barrier against the hot combustion gas 46, thereby preventing the wall from over heating.

Figure 6:
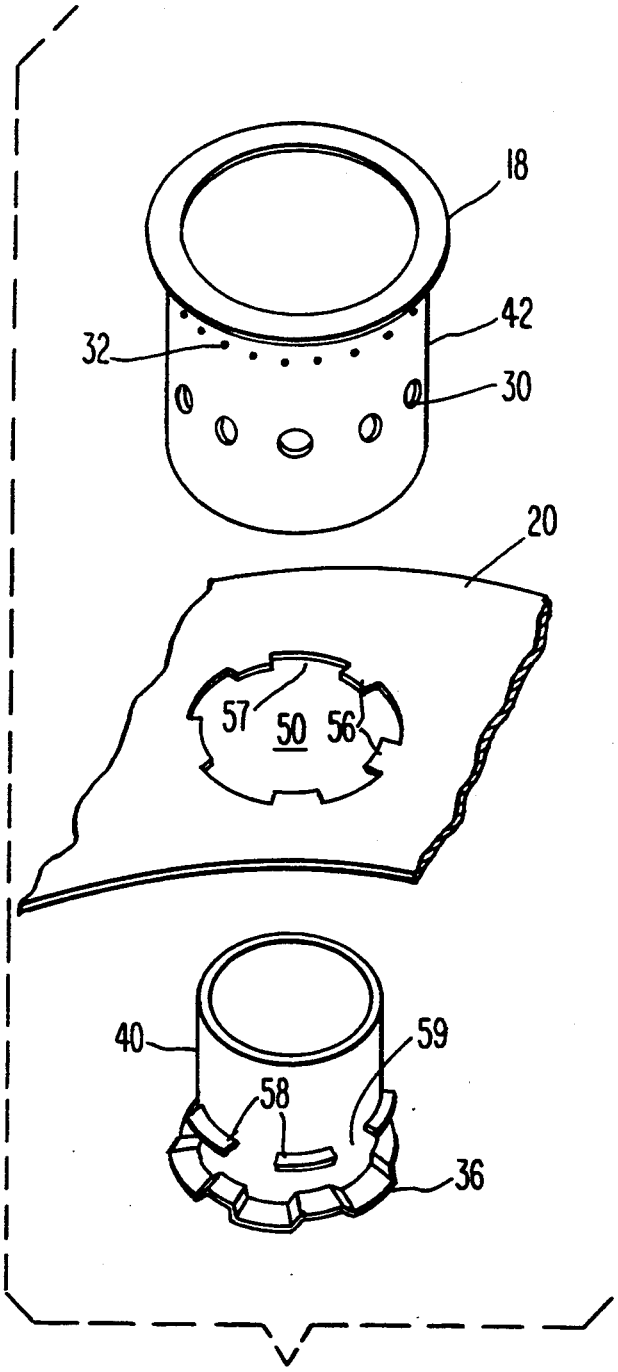
FIG. 6 is an exploded view of the cross-flame tube coupling shown in FIG. 4.

In the embodiment shown in FIGS. 4–6, the skirt has three depressed areas 53. The largest of the lands 52 is attached to the ring inner wall 48 at a location axially upstream of the hole 50. As a result, the depressed areas 53 are oriented so as to direct the flow of cooling air 28 out of the passage 34 in three directions, axially in the downstream direction and circumferentially in the clockwise and counterclockwise directions, as shown in FIG. 5. However, the pattern of lands 52 and depressed areas 53 could be formed so as to direct the flow in other ways as well, such as in the axially upstream direction.

Since the inner sleeve 40 has a smaller diameter than the hole 50 in the ring 20, there is a danger that the inner sleeve could slide out of the outer sleeve 42 and drop down into the combustor in the event the spot welds 38 failed. This situation could result in the inner sleeve 40 entering the gas flow path and traveling into the turbine section, thereby causing substantial impact damage to the rotating turbine blades.

Accordingly, in the preferred embodiment, means are employed to restrain the travel of the inner sleeve 40 within the outer sleeve 42 even if the spot welds 38 that secure the baffle 36 to the ring 20 fail. In the embodiment shown in FIGS. 4–6, this is accomplished by forming two sets of tabs. The first set of tabs 56 are formed in the ring 20 so as to extend radially inward into the hole 50. The second set of tabs 58 are formed around the circumference of the inner sleeve 40 so as to extend radially outward. The ring tabs 56 are slightly smaller than the spaces 59 between the sleeve tabs 58 and the sleeve tabs 58 are slightly smaller than the spaces 57 between the ring tabs 56.

At assembly, the inner sleeve 40 is inserted into the outer sleeve 42 via the hole 50, with the inner sleeve 40 oriented so that the sleeve tabs 58 slide through the spaces between the ring tabs 56 and the ring tabs slide through the spaces between the sleeve tabs. The inner sleeve 40 is then rotated so that the tabs 56 and 58 are aligned relative to the axis of the sleeve and the baffle 36 is spot welded to the ring 20. In the event that the spot welds 38 fail, the axial motion of the inner sleeve 40 within the outer sleeve 48 is restrained by the engagement of the tabs 56 and with the tabs 58.

Figure 10:
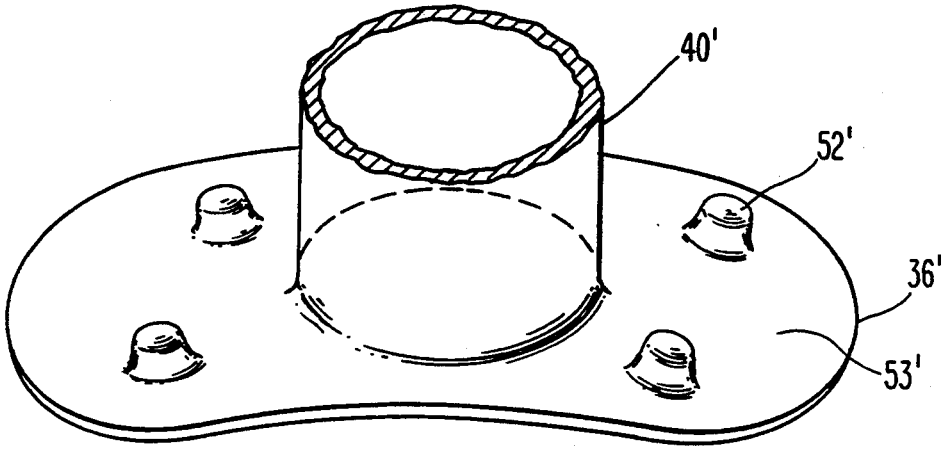
FIG. 10 is an isometric view of the proximal end of the inner sleeve of the cross-flame tube coupling shown in FIGS. 7–9.
Figure 7:
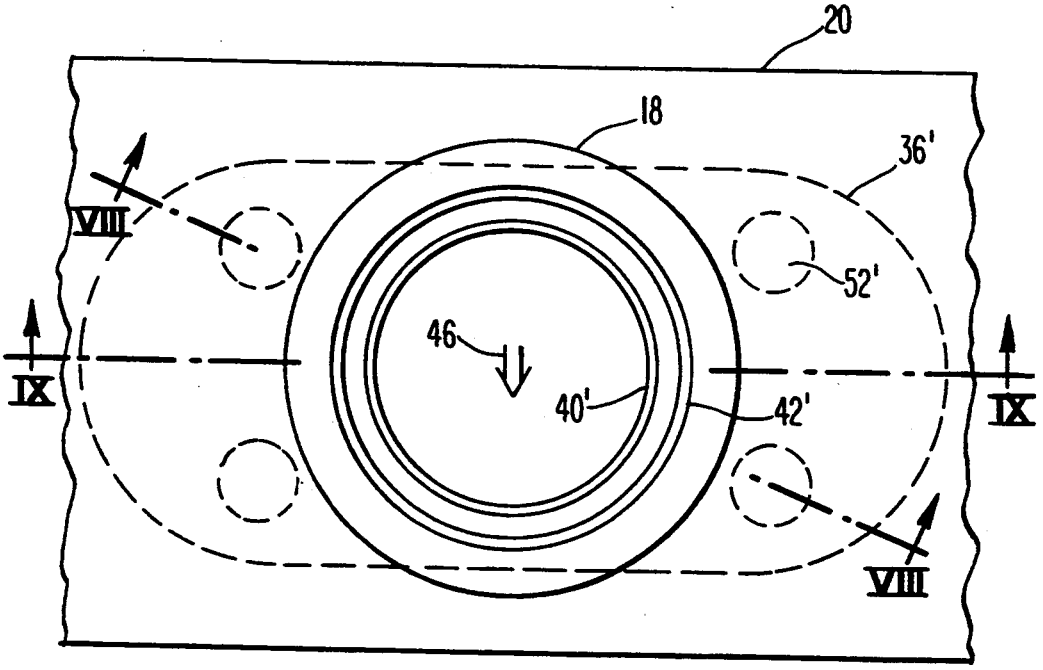
FIG. 7 is a plan view of an alternate embodiment of the cross-flame tube coupling portion of the combustor of the current invention.

FIGS. 7–10 show another embodiment of the current invention. In this embodiment, the inner and outer sleeves 40' and 42', respectively, form an annular passage 34' that is supplied with cooling air 28 via holes 30 in the outer sleeve, as before. However, the baffle 36' is formed by a plate having an arcuate shape that matches the curvature of the combustor ring inner wall 48. Also, the lands 52' are formed by dimples in the baffle plate 36'. Each of the lands 52' is attached to the inner wall 48 by spot welds 38, as before. As shown in FIGS. 7 and 10, four relatively small lands 52' are distributed around the baffle 36' so that there are four large depressed areas 53' that form the passage 35' between the inner wall 48 and the baffle.

As shown in FIG. 10, the depressed areas 53' are oriented so that the flow of cooling air 28 exits from the passage 35' over an essentially 360° arc, interrupted only by the lands 52'. As a result, streams of cooling air 28 are directed radially outward with respect to the axis of the inner sleeve 40. In so doing, the cooling air 28 flows axially, with respect to the axis of the combustor, in both the upstream and downstream directions and circumferentially in both the clockwise and counterclockwise directions.

Figure 8:
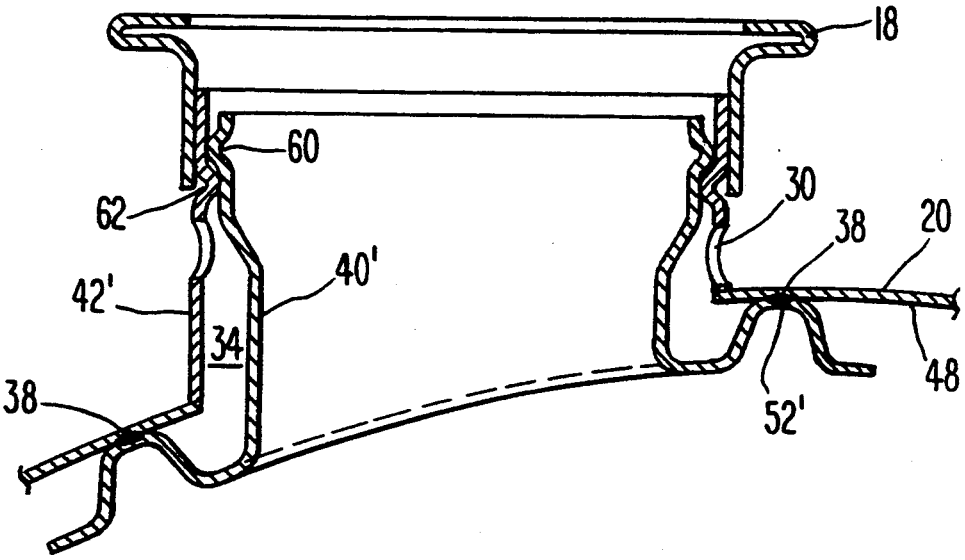
FIG. 8 a cross-section taken through line VIII–VII shown in FIG. 7.
Figure 9:
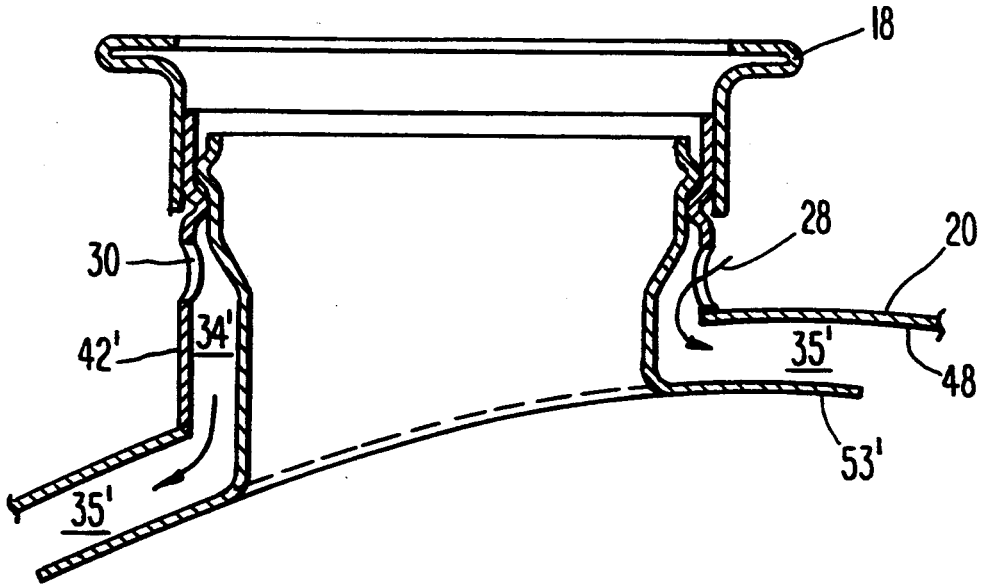
FIG. 9 is a cross-section taken through line IX—IX shown in FIG. 7.

In this embodiment, axial displacement of the inner sleeve 40' relative to the outer sleeve 42' in the event of a failure of the spot welds is restrained by forming interengaging projections 60 and 62 in the inner and outer sleeves 40' and 42', respectively, as shown in FIG. 8 These projections can be formed in a variety of ways. In the preferred embodiment, the projection 60 in the inner sleeve 40' is formed by a 360° outwardly extending rib and the projection 62 in the outer sleeve 42' is formed by inwardly extending dimples spaced around the circumference of the outer sleeve. At assembly, the inner sleeve 40' is forced upward so that elastic deformation allows the projection 60 to slip past the projections 62. In the event of a spot weld failure, the projections 60 and 62 restrain the movement of the inner sleeve 40' relative to the outer sleeve 42' so as to prevent the inner sleeve from dropping down into the combustor 6.

The present invention may be embodied in other specific forms without departing from the spirit or essential attributes thereof and, accordingly, reference should be made to the appended claims, rather than to the foregoing specification, as indicating the scope of the invention.

We claim:

1. A turbine comprising:

a shell forming a chamber therein containing compressed air; and a plurality of interconnected combustors disposed in said chamber, each of said combustors having a wall enclosing a combustion chamber with a cross-flame tube coupling leading therefrom; wherein said cross-flame tube coupling comprises an inner sleeve, an outer sleeve enclosing said inner sleeve forming a conduit passage therebetween, and a skirt associated with said inner sleeve having a plurality of lands and depressions such that said lands are disposed in proximity to said wall and said depressions are disposed in displacement from said wall forming a plurality of combustor passages; and wherein said plurality of combustor passages are in flow communication with said conduit passage and said outer sleeve has an opening whereby compressed air flows through said opening, said conduit passage, and said plurality of combustor passages for cooling said outer sleeve and said wall.

2. The turbine as recited in claim 1, wherein said skirt is corrugated forming said plurality of lands and depressions.

3. The turbine as recited in claim 1, wherein said skirt has raised dimples forming said plurality of lands and depressions.

4. The turbine as recited in claim 1, wherein said lands are welded to said wall.

5. The turbine as recited in claim 1, wherein said cross-flame tube coupling further comprises restraining means for restraining travel of said inner sleeve within said outer sleeve.

6. The turbine as recited in claim 5, wherein said restraining means comprises said inner sleeve having a set of inner sleeve tabs and said wall having a set of wall tabs such that said inner sleeve tabs are aligned relative to said wall tabs and engagable therewith.

7. The turbine as recited in claim 5, wherein said restraining means comprises said inner sleeve having a set of inner sleeve projections extending toward said outer sleeve and said outer sleeve having a set of outer sleeve projections extending toward said inner sleeve such that said inner sleeve projections are aligned relative to said outer sleeve projections and engagable therewith.

8. A combustor for use in a turbine, comprising:

a wall enclosing a combustion chamber and a cross-flame tube coupling leading therefrom; wherein said cross-flame tube coupling comprises an inner sleeve, an outer sleeve enclosing said inner sleeve forming a conduit passage therebetween, and a skirt associated with said inner sleeve having a plurality of lands and depressions such that said lands are disposed in proximity to said wall and said depressions are disposed in displacement from said wall forming a plurality of combustor passages; and wherein said plurality of combustor passages are in flow communication with said conduit passage and said outer sleeve has an opening whereby compressed air flows through said opening, said conduit passage, and said plurality of combustor passages for cooling said outer sleeve and said wall.

9. The combustor as recited in claim 8, wherein said skirt is corrugated forming said plurality of lands and depressions.

10. The combustor as recited in claim 8, wherein said skirt has raised dimples forming said plurality of lands and depressions.

11. The combustor as recited in claim 8, wherein said lands are welded to said wall.

12. The combustor as recited in claim 8, wherein said conduit coupling further comprises restraining means for restraining travel of said inner sleeve within said outer sleeve.

13. The combustor as recited in claim 12, wherein said restraining means comprises said inner sleeve having a set of inner sleeve tabs and said wall having a set of wall tabs such that said inner sleeve tabs are aligned relative to said wall tabs and engagable therewith.

14. The combustor as recited in claim 12, wherein said restraining means comprises said inner sleeve having a set of inner sleeve projections extending toward said outer sleeve and said outer sleeve having a set of outer sleeve projections extending toward said inner sleeve such that said inner sleeve projections are aligned relative to said outer sleeve projections and engagable therewith.

15. A turbine comprising:

a shell forming a chamber therein containing compressed air; and a plurality of interconnected combustors disposed in said chamber, each of said combustors having a wall enclosing a combustion chamber and a cross-flame tube coupling leading therefrom; wherein said cross-flame tube coupling comprising an inner sleeve, an outer sleeve enclosing said inner sleeve forming a conduit passage therebetween, and a skirt associated with said inner sleeve having a plurality of lands welded to said wall and depressions disposed in displacement from said wall forming a plurality of combustor passages; wherein said plurality of combustor passages are in flow communication with said conduit passage and said outer sleeve has an opening whereby compressed air flows through said opening, said conduit passage, and said plurality of combustor passages for cooling said outer sleeve and said wall; and wherein said cross-flame tube coupling further comprises restraining means for restraining travel of said inner sleeve within said outer sleeve.

* * * * *